United States Patent [19]

Keller et al.

[11] 4,027,996

[45] June 7, 1977

[54] TURBOMACHINE, SUCH AS A STEAM TURBINE WITH HIGH STEAM INLET TEMPERATURE, ESPECIALLY

[75] Inventors: Herbert Keller; Bruno Krieg; Ludwig Römer, all of Mulheim, Germany

[73] Assignee: Kraftwerk Union Aktiengesellschaft, Mulheim (Ruhr), Germany

[22] Filed: July 18, 1975

[21] Appl. No.: 597,300

[30] Foreign Application Priority Data

July 22, 1974 Germany ..... 2435153

[52] U.S. Cl. ..... 415/116; 415/193

[51] Int. Cl.[2] ..... F01D 25/24

[58] Field of Search ..... 415/199 R, 116, 203, 415/184, 101, 193, 194, 198

[56] References Cited

UNITED STATES PATENTS

| | | | |
|---|---|---|---|
| 1,328,835 | 1/1920 | Kasley | 415/203 |
| 1,440,395 | 1/1923 | Ljungstrom | 415/193 |
| 2,923,526 | 2/1960 | Street, Jr. | 415/205 |
| 3,231,238 | 1/1966 | Hoffstrom | 415/186 |
| 3,233,867 | 2/1966 | Ishibashi et al. | 415/193 |
| 3,804,335 | 4/1974 | Sohre | 415/199 R |
| 3,861,821 | 1/1975 | Keller et al. | 415/101 |

FOREIGN PATENTS OR APPLICATIONS

| | | | |
|---|---|---|---|
| 174,674 | 10/1906 | Germany | 415/199 R |
| 377,378 | 6/1964 | Switzerland | 415/199 R |
| 345,888 | 4/1931 | United Kingdom | 415/116 |
| 776,847 | 1/1957 | United Kingdom | 415/116 |

*Primary Examiner*—Henry F. Raduazo
*Attorney, Agent, or Firm*—Herbert L. Lerner

[57] ABSTRACT

A turbomachine having a stationary housing and a rotatable rotor mounted therein and including a series of rotor blade rings carried by the rotor and a series of guide vane rings carried by the housing, the guide vane rings and the rotor blade rings being disposed in mutually alternating relationship, further includes means defining an annular space located forward of the first rotor blade ring of the series of rotor blade rings, flow medium supply means communicating with the annular space for supplying flow medium thereto, the annular space extending radially outwardly and along the entire periphery of the turbomachine for producing a torsional flow of the flow medium, the rotor having a shaft formed with a collar, and the series of rotor blade rings including a first blade ring mounted on the collar directly behind the annular space and having a diameter greater than that of the succeeding blade rings of the series, whereby the flow medium supplied to the annular space axially impinges directly on the first blade ring without being initially guided by any guide vane rings.

2 Claims, 2 Drawing Figures

Figure 1:
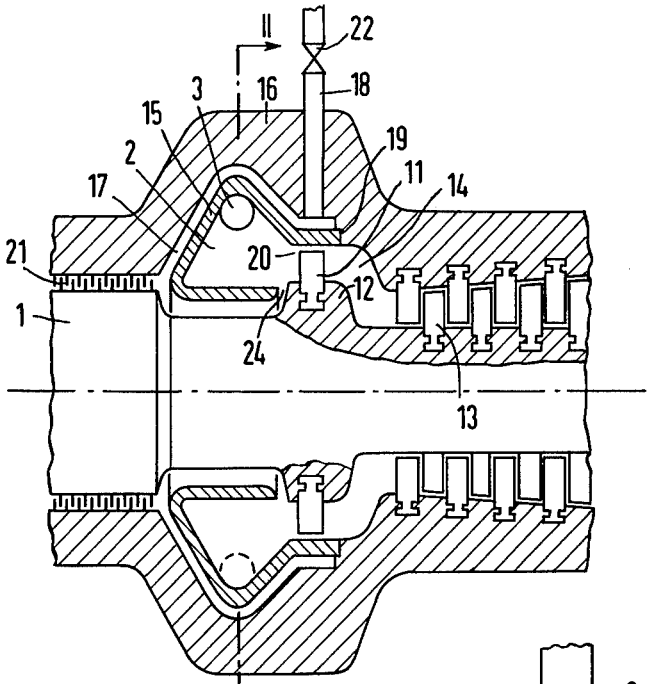

TURBOMACHINE, SUCH AS A STEAM TURBINE WITH HIGH STEAM INLET TEMPERATURE, ESPECIALLY

The invention relates to a turbomachine, and especially to a steam turbine having a high steam inlet temperature. More specifically, the invention relates to such a turbomachine that is provided with an annular space for producing a torsional flow in a flow medium supplied thereto, the annular space extending radially outwardly and along the entire periphery forward of the first rotor blade ring, the first rotor blade ring being directly subjected to impingement of the flow medium in axial direction without any guide vane ring being disposed forward therof. The turbomachine of the invention is also of the type having individually controllable supply lines for flow medium connected tangentially to the annular space.

A turbomachine of the foregoing general type has become known heretofore from U.S. Pat. No. 3,861,821. With a construction of the flow inlet region of this known turbomachine, which ensures uniform flow medium impingement upon the first rotor blade ring and good efficiency even at partial load, a high stressing or loading of the material defining the annular channel and forming the first rotor blade ring can occur at high flow medium inlet temperatures.

It is accordingly an object of the invention to provide a turbomachine of the foregoing type with a device for rapidly reducing the high flow-medium inlet temperatures in the turbine without loss of efficiency or for markedly minimizing the effects of the high flow-medium inlet temperatures on the flow inlet regions of the turbine.

With the foregoing and the objects in view, there is provided in accordance with the invention, a turbomachine having a stationary housing and a rotatable rotor mounted therein and including a series of rotor blade rings carried by the rotor and a series of guide vane rings and the rotor blade rings being disposed in mutually alternating relationship, comprising means defining an annular space located forward of the first rotor blade ring of the series of rotor blade rings, flow medium supply means communicating with the annular space for supplying flow medium thereto, the annular space extending radially outwardly and along the entire periphery of the turbomachine for producing a torsional flow of the flow medium, the rotor having a shaft formed with a collar, and the series of rotor blade rings including a first blade ring mounted on the collar directly behind the annular space and having a diameter greater than that of the succeeding blade rings of the series, whereby the flow medium supplied to the annular space axially impinges directly on the first blade ring without being initially guided by any guide vane rings.

In accordance with another feature of the invention, the turbomachine includes a separate radially symmetrical casing defining the annular space and located between the turbomachine housing and the shaft of the rotor, a substantially circular, axially-directed flow medium outlet for the annular space being disposed directly forward of the first blade ring.

In accordance with a further feature of the invention, the annular space casing is spaced from the turbomachine housing and the shaft of the rotor, and the space thus defined by the turbomachine housing as well as the rotor shaft, on the one hand, and by the annular space casing, on the other hand, has outlet gaps to the first blade ring and to an outer sealing system between the turbomachine housing and the rotor shaft. Additionally included in the turbomachine are separate supply means for relatively colder flow medium communicating with the space defined by the annular space casing, on the one hand, and the turbomachine housing and the rotor shaft, on the other hand.

Due to the construction, in accordance with the invention, of the first rotor blade ring on a collar of the rotor shaft and with a greater diameter than that of the succeeding rotor blade rings, a large gradient can be processed in this first stage and, thereby, the temperature may be reduced so that the succeeding stages are subjected to impingement by flow medium that is already of lower temperature. By defining the annular space with a separate casing and cooling the remaining gap with cooled medium or with medium that has already performed work and therefore has a lower temperature, the annular space region and the region of the first rotor blade ring are thus reliably shielded from the high inlet temperatures.

Other features which are considered as characteristic for the invention are set forth in the appended claims.

Although the invention is illustrated and described herein as embodied in turbomachine, such as a steam turbine with high steam inlet temperature, especially, it is nevertheless not intended to be limited to the details shown, since various modifications and structural changes may be made therein without departing from the spirit of the invention and within the scope and range of equivalents of the claims.

Figure 2:
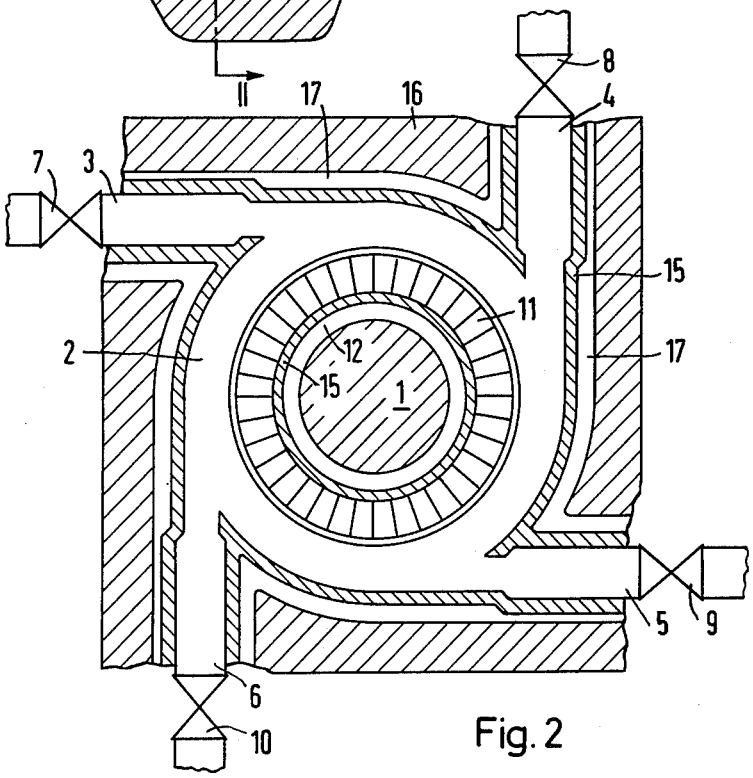

The construction and method of operation of the invention, however, together with additional objects and advantages thereof will be best understood from the following description of specific embodiments when read in connection with the accompanying drawing, in which:

FIG. 1 is a longitudinal sectional view of part of a turbine showing the intake region thereof; and FIG. 2 is a cross-sectional view of FIG. 1 taken along the line II—II in the direction of the arrows.

Referring now to the figures of the drawing, there is shown therein the live steam intake region of a turbine, that is formed with an annular space 2 extending radially outwardly from and along the entire priphery of the turbine shaft 1. Four supply inlets 3, 4, 5 and 6 for a flow medium extend tangentially to and are in communication with the annular space 2, as is specially seen in FIG. 2. The supply inlets 3 to 6 are provided with respective independently controllable throttling valves 7, 8, 9 and 10, shown schematically in FIG. 2, so that, in the sense of quantity regulation or control, depending upon the demand for the throughput quantity or the flow-through rate, one or more of the supply inlets 3 to 6 can be throttled or closed.

In the radially symmetrical annular space 2, a spiral or helical torsional flow is accordingly formed, which experiences a different development or formation depending upon the number of the supply inlets 3 to 6 that are opened. The thus resulting variable slope or pitch of the spiral or helical flow lines is comparable to the inclination of the flow channels in adjustable guide blades and also has a function corresponding to the function thereof. A consequence of the foregoing construction is hat a succeeding rotor blade ring 11 is directly and uniformly subjected to steam pressure without intervening guide blades, even if one or more of the supply inlets 3 to 6 are throttled or closed.

In order to avoid high temperature loading or stressing of the drum stages, in accordance with the invention, the rotor blade ring 11 directly following the annular space 2 is disposed on a collar 12 formed on the turbine shaft, and having a diameter larger than those of the following drum or ring stages 13. Due to the greater diameter of the first stage 11, it can process a larger gradient, so that the high temperature of the medium is already partly reduced in the flow space 14 behind the rotor blade ring 11, and the drum stages 13 can operate with a medium of lower temperature.

In order to reduce the temperature loading of the supply inlet region, the annular space 2 per se is of special construction. As can be seen from FIG. 1, the annular space 2 per se is defined or surrounded by a separate radially symmetrical casing 15 formed of a very rigid or firm material. This casing 15 for the annular space 2 is spaced from the shaft 1 and from the turbine housing 16, so that a substantially circular intermediate space 17 is formed between the turbine housing 16 as well as the shaft 1, on the one hand, and the casing 15 for the annular space 2, on the other hand. This intermediate space 17 is subjected to or traversed by a cooler medium conducted through a line 18 which extends through the turbine housing 16 and communicates with the intermediate space 17, thereby shielding the turbine housing 16 per se, in the inlet region thereof, from the operating medium proper.

The casing 15 for the annular space 2 also extends over the wall region of the turbine housing 16 that is located opposite the first rotor blade ring 11, the casing 15 for the annular space 2 being directly connected to the turbine housing 16 at a location 19 thereof. The casing 15 for the annular space 2 is accordingly provided, for the blading, with a substantially circular axially directed steam outlet 20 directly forward of the first rotor blade ring 11, so that the steam axially impinges on the rotor blade ring 11. A discharge gap 24 from the intermediate space 17 communicates with the annular space 2, the discharge gap 24 being located directly forward of the first rotor blade ring 11 at the level of the periphery of the collar 12. Another outlet for the cooling medium traversing the intermediate space 17 is provided also to the outer shaft sealing system 21.

By means of a suitable throttle 22 provided in the cooling-medium supply line 18, the coolant supply can be so regulated, that the maximal possible cooling effect is obtained with the least possible medium.

By means of the aforedescribed device, quantity regulation with uniform impingement upon the first rotor blade state is therefore possible with relatively good efficiency in a relatively simple manner even for varying loads the temperature loading or stressing of the blade rows and of the supply inlet region having been remarkedly reduced, however.

There is claimed:

1. A turbomachine having a stationary housing and a rotatable rotor mounted therein and including a series of rotor blade rings carried by the rotor and a series of guide vane rings carried by the housing, the guide vane rings and the rotor blade rings being disposed in mutually alternating relationship beginning with a first rotor blade ring, comprising means defining an annular space located forward of the first rotor blade ring of the series of rotor blade rings, flow medium supply means communicating with said annular space for supplying flow medium thereto, said annular space extending radially outwardly and along the entire periphery of the turbomachine for producing a torsional flow of the flow medium, the rotor having a shaft formed with a collar, and the series of rotor blade rings including a first blade ring mounted on said collar directly behind said annular space and being fully exposed at all times directly to said annular space, said first blade ring having a diameter greater than that of the succeeding blade rings of said series, whereby the flow medium supplied to said annular space axially impinges directly on said first blade ring without being initially guided by any guide vane rings, said means defining an annular space comprising a casing spaced from the housing and from the rotor, said casing extending to a location at which it is disposed in spaced relationship between the housing and said first rotor blade ring, and means for supplying flow medium to the space between the housing and said casing cooler than the flow medium supplied to said annular space by said flow medium supply means whereby the housing in the region of said annular space is shielded by cooler medium from the thermal effect of the hotter medium supplied to said annular space.

2. A turbomachine according to claim 1 wherein said flow medium supply means communicating with said annular space comprise a plurality of steam inlet channels disposed tangentially to said annular space, said channels being defined by respective extensions of said casing.

* * * * *